US005816747A

United States Patent [19]

Welch et al.

[11] Patent Number: 5,816,747

[45] Date of Patent: Oct. 6, 1998

[54] DEVICE FOR CUTTING A LARGE DIAMETER PIPE AND INITIATION MANIFOLD THEREFOR

[75] Inventors: Brendan M. Welch, Farmington; Daniel A. Toro, Waterbury, both of Conn.

[73] Assignee: The Ensign-Bickford Company, Simsbury, Conn.

[21] Appl. No.: 640,492

[22] Filed: May 1, 1996

[51] Int. Cl.[6] ..... E02D 9/04

[52] U.S. Cl. ..... 405/232; 166/55; 175/4.52; 405/227

[58] Field of Search ..... 405/224, 227, 405/232, 234, 237; 166/55; 114/221; 89/1.15; 175/4.52

[56] References Cited

U.S. PATENT DOCUMENTS

| | | | |
|---|---|---|---|
| 2,591,807 | 4/1952 | Greene | 405/234 X |
| 2,737,115 | 3/1956 | Bissell | 175/4.52 |
| 3,222,842 | 12/1965 | Luedloff et al. | 405/234 X |
| 4,619,556 | 10/1986 | Parra | 405/227 X |
| 4,768,899 | 9/1988 | Dysarz | 405/227 X |
| 4,799,829 | 1/1989 | Kenny | 405/232 X |
| 5,177,321 | 1/1993 | Kenny | 166/55 X |

*Primary Examiner*—Dennis L. Taylor
*Attorney, Agent, or Firm*—Law Office of Victor E. Libert; Frederick A. Spaeth

[57] ABSTRACT

A device (10) for explosively cutting a pipe (40) having an inner circumference has a carrier member (12) having a circumference. A support structure, such as a spring steel band (20), is releasably carried on the carrier member (12) in a retracted configuration by an explosive bolt (24) and is biased towards an extended configuration. The retracted configuration facilitates insertion of the device into the pipe (40). A linear charge of explosive material, e.g., shock wave refractive tape (26), is secured to the support structure. When the bolt (24) is fired, the spring band (20) is released from the carrier member (12) and moves to the extended configuration in which the linear charge engages the interior of the pipe (40) to facilitate cutting the pipe. Initiation manifolds (42) mounted on the support structure receive an initiation signal and detonate the linear charge at both sides thereof. In an alternative embodiment, the device (10) carries a plurality of segments of linear explosive charges (126) in a staggered arrangement about the device. Pneumatic cylinders (125) may be used to move the charges (126) from their retracted configurations to the extended configurations.

15 Claims, 11 Drawing Sheets

DEVICE FOR CUTTING A LARGE DIAMETER PIPE AND INITIATION MANIFOLD THEREFOR

BACKGROUND OF THE INVENTION

1. Field of the Invention

The present invention relates to devices for cutting pipes and, in particular, to devices for cutting pipes by the use of explosive charges.

Metal piping is a common structural element of oil platforms, particularly for piles of off-shore oil platforms. When operations at an off-shore well site are concluded and the structure is to be abandoned, it is common practice to remove the platform from the site. To do this, it is necessary to cut the pipes that are used for the platform piles, usually at a point beneath the ocean floor. Such pipes are large in diameter, e.g., they may have an internal diameter of about 3 to 4 feet, although the present invention can be used to cut pipes having a wider range of diameters. A variety of devices are known in the prior art for cutting such pipes through the use of explosive charges inserted therein.

2. Related Art

U.S. Pat. No. 2,737,115 to Bissell, dated Mar. 6, 1956, discloses an apparatus for explosively fracturing tubular members. The apparatus includes a carrier member frame (1) (FIG. 1) that is surrounded by a rubber or plastic diaphragm (6) which serves as a support structure for an encircling explosive charge (9), the length of which appears to be limited by the circumference of the device. The device is inserted into a pipe and air is pumped into the diaphragm (6) so that it expands around the frame (1), causing the explosive charge (9) to approach the pipe wall (41). The explosive charge is then fired. In the embodiment of FIG. 2, the frame, diaphragm and explosive charge are dimensioned and configured to fit around the outside of the pipe and, when inflated, the diaphragm expands inwardly so that the explosive charge approaches the outside of the pipe. In both embodiments, the support structure diaphragm must remain hermetically secured to the carrier frame to move the explosive material towards the pipe well.

U.S. Pat. No. 4,116,130 to Christopher et al, dated Sep. 26, 1978, discloses an explosive pipe-cutting device that delivers two rigid semi-circular trains of explosive material to the interior of the pipe. The semi-circles are hinged and folded together to facilitate insertion of the device into the pipe and are deployed by means of a pneumatic mechanism when the device is at the location desired for cutting.

SUMMARY OF THE INVENTION

The present invention relates to a device for explosively cutting a pipe having a longitudinal axis, an inner wall and an internal circumference. The device generally comprises a carrier member having a periphery and a movable circumferential explosive means for providing an explosive force about the interior circumference of the pipe, to cut the pipe. The explosive means has at least one mid-portion and two ends. Deployment means carried on the carrier member holds the explosive means in a retracted configuration and moves the explosive means from the retracted configuration to a circumferential extended configuration that exceeds the periphery of the carrier member, so that the explosive means can engage the inner wall of the pipe to be cut. At least one end of the explosive means is disposed in an axially overlapping configuration with respect to another end. The device includes initiation means for initiating the explosive means when it is in the extended configuration.

According to one aspect of the invention, the explosive means may comprise a plurality of explosive charge segments. Optionally, the extended configuration of the explosive charge segments may be a staggered arrangement about the periphery of the carrier member.

According to another aspect of the present invention, the deployment means biases the explosive means towards a configuration that defines a radius larger than the radius of the interior circumference of the pipe to be cut.

According to still another aspect of the invention, the explosive means may comprise a pair of generally parallel sides and the initiating means may comprise at least one initiation manifold dimensioned and configured to receive an initiation signal and to detonate the explosive means at both sides thereof in response to the initiation signal.

According to yet another aspect of the invention, the device may comprise releasable restraining means for releasably holding the deployment means in the retracted configuration.

In a particular embodiment, the deployment means may comprise a movable elongate support structure, e.g., a spring band, and the retracted configuration and the extended configuration may be helical configurations. Preferably, the elongate support structure has a length that exceeds the circumference of the carrier member. The circumferential explosive charge may also have a length that exceeds the inner circumference of the pipe.

The device preferably comprises a plurality of centering arms mounted to the carrier member. The centering arms may be movable between a retracted configuration for facilitating insertion of the device into the pipe and an extended configuration engaging the pipe wall to center the device within the pipe. The arms may be biased towards the extended configuration, and the device may comprise a release mechanism for releasably holding the arms in the retracted configuration. Alternatively, the centering arms may comprise a plurality of resilient members that extend radially from the carrier member and that are dimensioned and configured to extend from the carrier member for a distance that exceeds the internal radius of the pipe to be cut. When the device is inserted into the pipe, the resilient members may bear against the interior surface of the pipe to center the device therein. The device may optionally comprise sensor means for signaling to the user when the explosive means has engaged said inner wall.

The invention also provides a manifold for transmitting a plurality of initiation signals to a charge of explosive material. The manifold may comprise an aperture for receiving an initiation device and a branched internal conduit extending from the aperture to a plurality of initiation ports. The manifold may be dimensioned and configured so that the initiation ports may be juxtaposed with the charge of explosive material, and comprises a charge of explosive material in the conduit for transmitting an initiation signal from the aperture to the plurality of initiation ports.

DETAILED DESCRIPTION OF THE INVENTION AND PREFERRED EMBODIMENTS THEREOF

The present invention relates to pipe-cutting devices that comprise a circumferential explosive means. The circumferential explosive means may comprise one or more linear charges of explosive material each having a mid-portion and two ends. When in position for firing, at least one linear charge is disposed in a circumferential configuration about the interior of the pipe with the one end of each charge overlapping another end. This allows for explosive material to be in contact with the pipe at all points about the interior circumference of the pipe. The overlapping ends are disposed in close axial proximity, usually about one width of explosive material apart, so that when the explosive material detonates, fractures form in the pipe not only along the lengths of the explosive material but also between the overlapping ends.

Figure 1A:
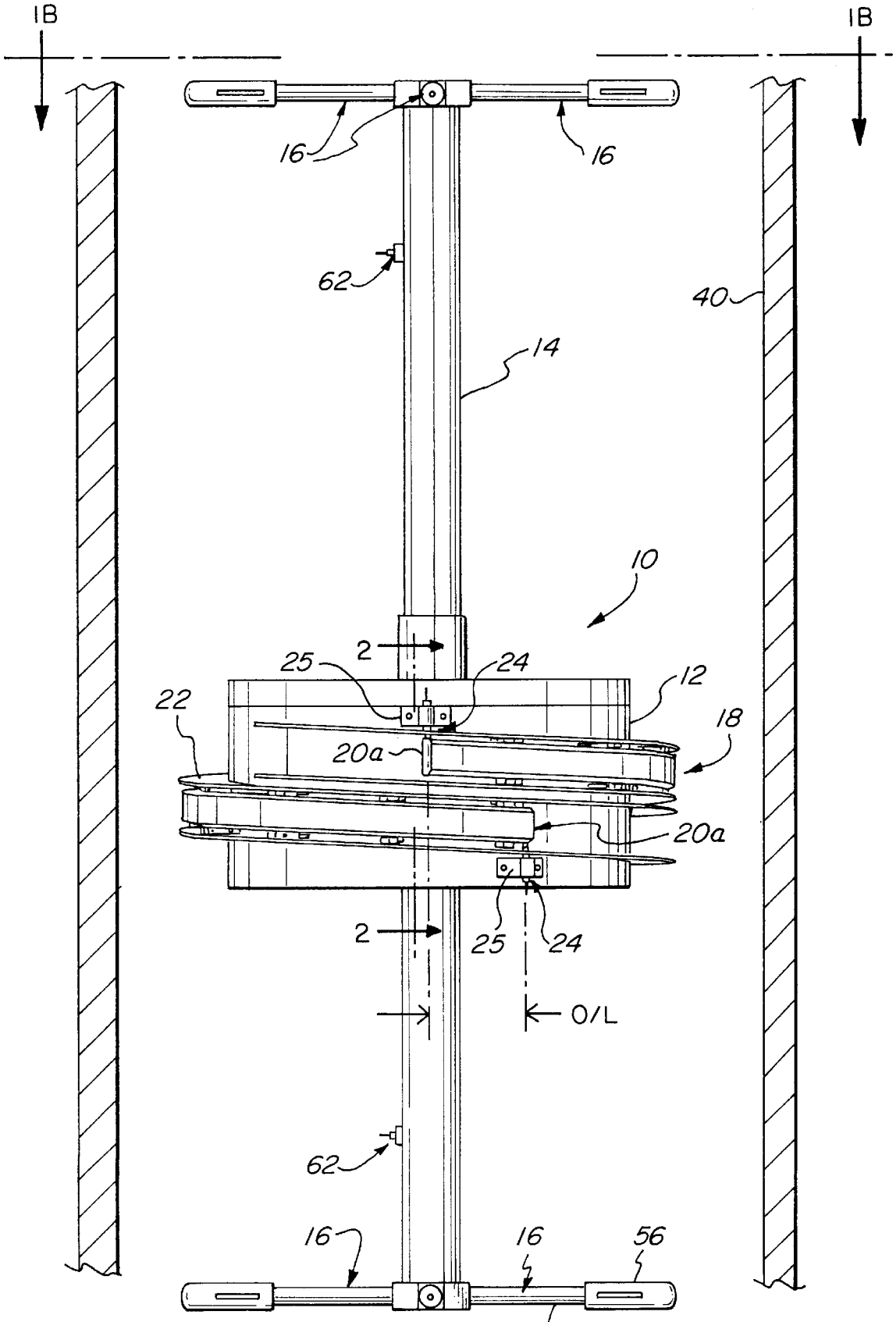
FIG. 1A is an elevation view of a pipe-cutting device in accordance with one embodiment of the present invention.
Figure 1B:
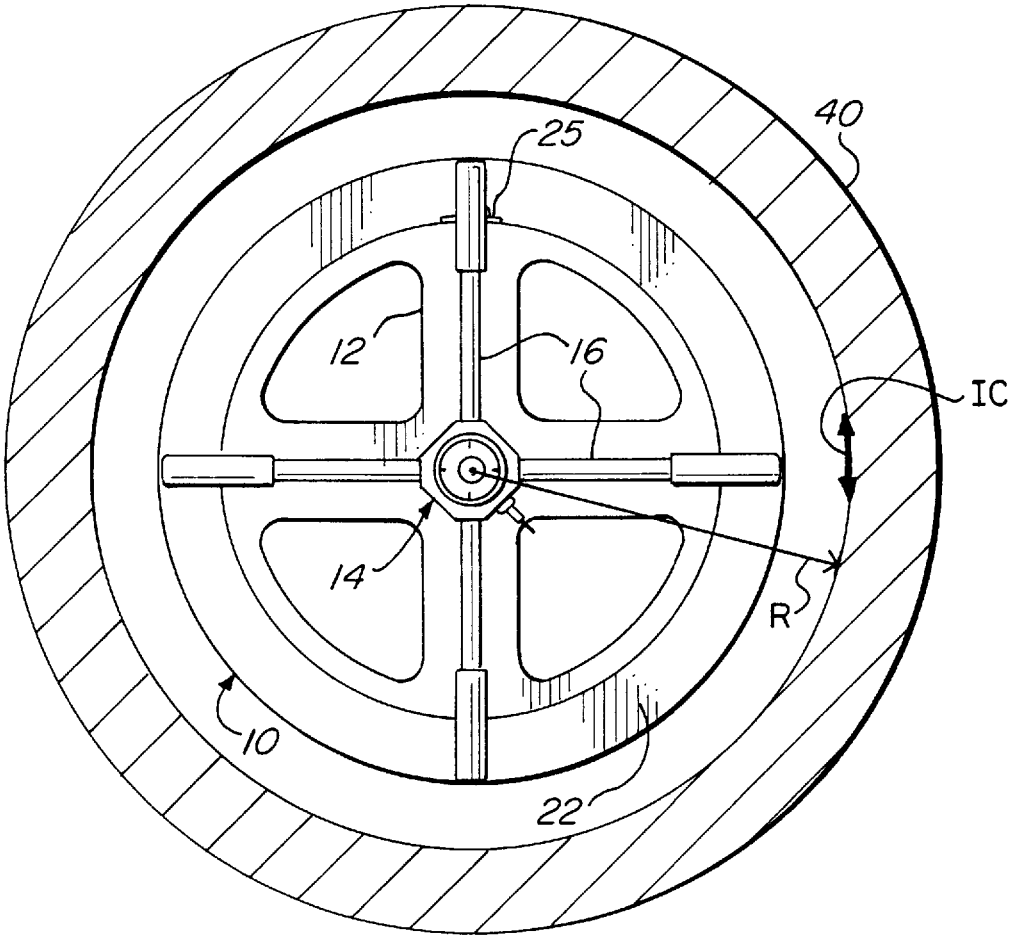
FIG. 1B is a plan view of the device of FIG. 1A, taken along line 1B—1B of FIG. 1A.

A cutting device in accordance with one embodiment of the present invention is shown in FIGS. 1A and 1B inside pipe 40. Device 10 comprises a generally cylindrical carrier member 12 that comprises an axially disposed mandrel 14 which has two ends and carries centering arms 16 at each end. Centering arms 16 extend radially from mandrel 14 and are symmetrically distributed about mandrel 14, e.g., at ninety-degree intervals as seen in FIG. 1B, and are discussed further below.

A circumferential explosive means that comprises a single length of a movable linear charge of explosive material (unnumbered) is mounted on carrier member 12 in a helical configuration by deployment means. The deployment means in a device according to the present invention serves to move the circumferential explosive charge from a retracted configuration to an extended configuration. The retracted configuration facilitates insertion and positioning of the device in the pipe; the extended configuration facilitates proper explosive cutting of the pipe by the explosive charge. The deployment means in the embodiment of FIG. 1A comprises a stainless steel spring band 20, shown in FIG. 2, which is flexed into a retracted configuration in which it is releasably mounted on carrier member 12. At each end, band 20 terminates in a sleeve 20*a* where the deployment means comprises a bolt by which band 20 is secured to carrier member 12. The securing bolt extends from a mooring 25 and through the wall of channel 22, and then into sleeve 20*a*. For brevity of expression, assembly of spring band 20 and the linear charge of explosive material mounted thereon are sometimes referred to herein as a "sub-assembly".

In the illustrated embodiment, the circumferential explosive charge is a linear explosive charge in the form of shock wave refractive tape 26 and is attached to band 20 by a plurality of spacers 28 that are distributed periodically along the length of band 20. The spacers 28 may be secured to band 20 by any convenient means, e.g., by screws 20*b*. Shock wave refractive tape 26 comprises a continuous linear charge of one or more explosive materials, e.g., a ribbon 30 (FIG. 2) of explosive material such as PETN and nitrocellulose in a binder material, such as is commercially available from The Ensign-Bickford Company under the trade designation PRIMASHEET™ 1000, and further comprises a second ribbon 32 of explosive material such as RDX in a binder, such as is commercially available from The Ensign-Bickford Company under the trade designation PRIMASHEET™ 2000. The outer circumferential surface of shock wave refractive tape 26, i.e., the exterior radial surface, conforms to a wave-shaping element 34 which is an elongated strip of rubber attached to spacers 28 by mounting screws (not shown). Wave-shaping element 34 serves to maintain the outer circumferential surface of tape 26 in a concave configuration with respect to the interior surface of pipe 40, to focus the energy of detonation of tape 26 onto the pipe for improved cutting efficiency. Thus, tape 26 constitutes a linear shaped charge disposed in a helical configuration. The invention, however, is not limited to the use of shock wave refractive tape; any elongate linearly configured explosive charge having sufficient strength to cut the pipe may be used. In alternative embodiments, the circumferential explosive charge may comprise a series of axially aligned segments of linear explosive material disposed end-to-end on the deployment means, instead of a continuous length of explosive material.

Figure 2:
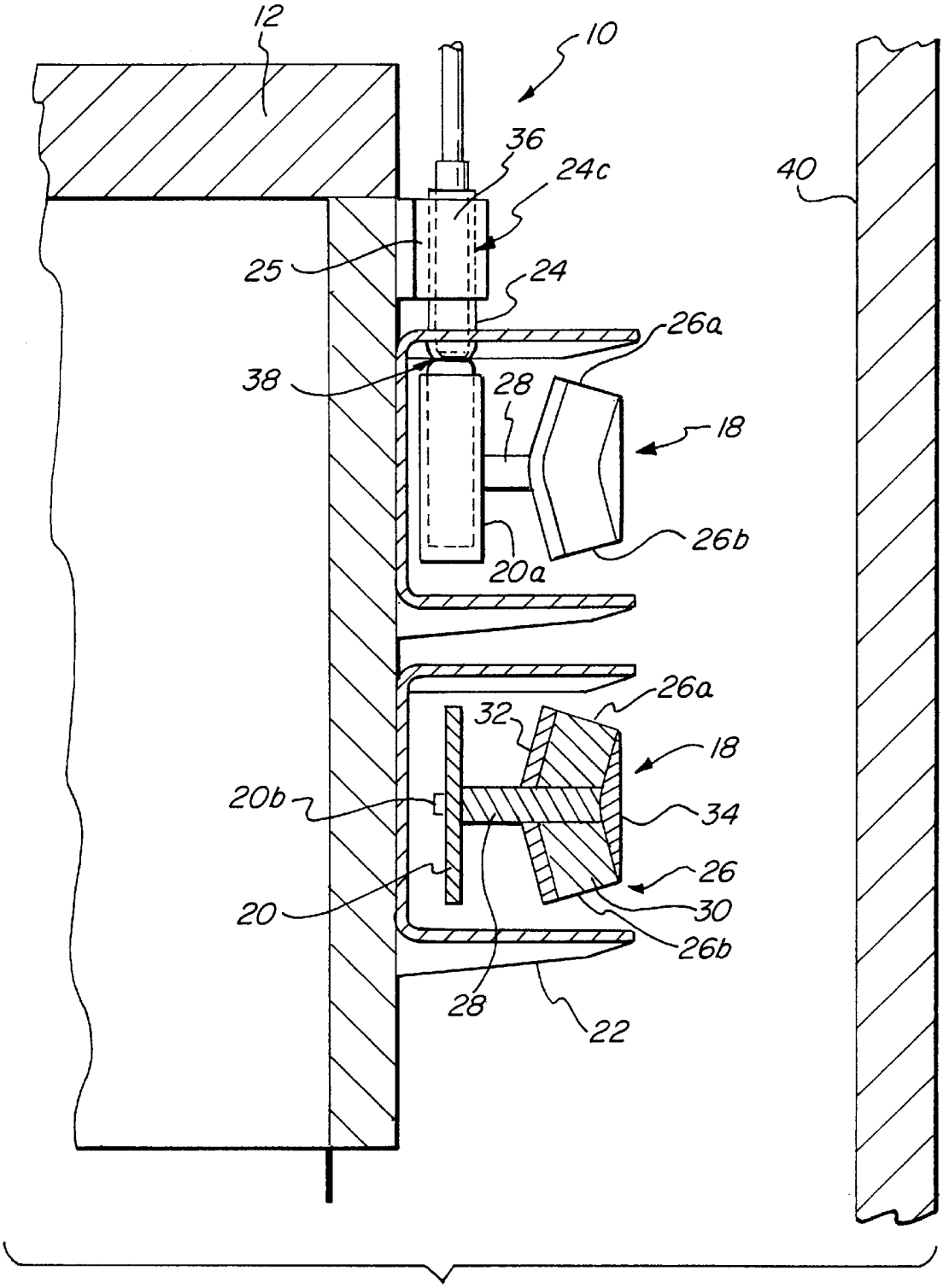
FIG. 2 is a partly cross-sectional view, on an enlarged scale, of the device of FIG. 1A, taken along line 2—2 of FIG. 1A.

The sub-assembly 18 is held in the retracted configuration by releasable restraining means comprising an explosive bolt 24 that extends through a mooring 25, through channel 22 and into sleeve 20*a* at the end of band 20. Moorings 25 and band 20 are situated and dimensioned, respectively, so that when the ends of band 20 are secured in place by bolts 24, sub-assembly 18 has a helical configuration having a diameter less than the inner diameter of pipe 40 even if the length of sub-assembly 18 exceeds the inner circumference of pipe 40 (indicated at line IC in Figure 1B). Thus, sub-assembly 18 does not prevent the insertion of device 10 into pipe 40 when in the retracted configuration. Preferably, as seen in FIGS. 1A, 1B and 2, channel 22 is dimensioned and configured so that when sub-assembly 18 is secured to carrier member 12 in the retracted configuration, it is disposed entirely within channel 22. Thus, channel 22 can shield sub-assembly 18 from damage while the device passes through pipe 40 to the desired position.

Figure 3:
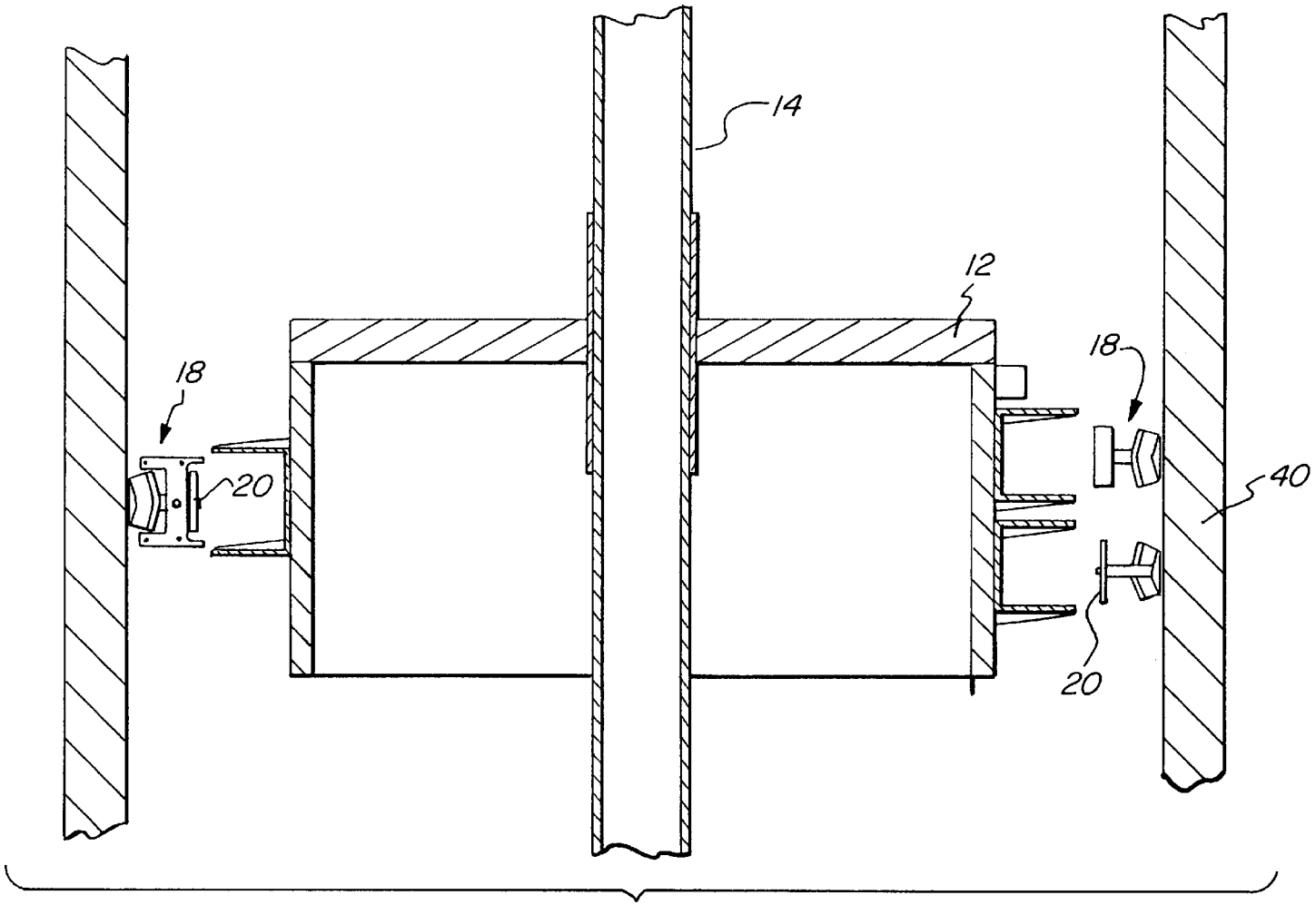
FIG. 3 is a partly cross-sectional view, on an enlarged scale, of the device of FIG. 1A, with the sub-assembly in the expanded configuration.

As indicated above, the end-to-end length of sub-assembly 18 may be greater than the internal circumference of pipe 40 due to the helical configuration in which subassembly 18 is carried on carrier member 12. In the helical configuration, the ends of sub-assembly 18 may overlap to length O/L as it winds around the circumference IC of sub-assembly 18 (FIG. 1B) to allow the length of sub-assembly 18 to be at least equal to the interior circumference of pipe 40. Thus, when sub-assembly 18 is released from carrier member 12 to engage the inner surface of pipe 40, it will engage the entire internal circumference of pipe 40, as indicated in FIG. 3. Optionally, overlap O/L may be sufficient to allow a similar overlap when sub-assembly 18 engages the inner surface of pipe 40, as suggested in FIG. 3 by the vertical, i.e. axial, juxtaposition of the two ends of sub-assembly 18 in the right side of the Figure. In other words, the length of sub-assembly 18 may exceed the inner circumference of pipe 40.

Each explosive bolt 24 that holds sub-assembly 18 to carrier member 12 has a hollow portion 24*a* within which a conventional detonator cap 36 may be received. Explosive bolt 24 defines a circumferential shear groove 38 where explosive bolt 24 fractures when detonator cap 36 is fired, thus releasing the end of band 20 from carrier member 12. Bolt 24 and mooring 25 thus provide a release coupling for releasably securing band 20 to carrier member 12. Bolt 24 may be severed by firing the detonator cap therein via a fuse line fired by the operator, as described below. The signal transmission lines or fuse 35 lines that extend from the detonator caps in bolts 24 stem from a common initiation point so that they can be fired together using a single initiation device. In an alternative embodiment, the explosive charge may be moved from the retracted configuration to the extended configuration using pneumatic cylinders for deployment means, as described below. The linear charge of sub-assembly 18, once released within pipe 40, can be initiated in any conventional manner, e.g., by disposing a detonator cap or the end of a length of detonating cord in initiating relation to the explosive charge and initiating the cap or cord from a distant location.

Figure 4:
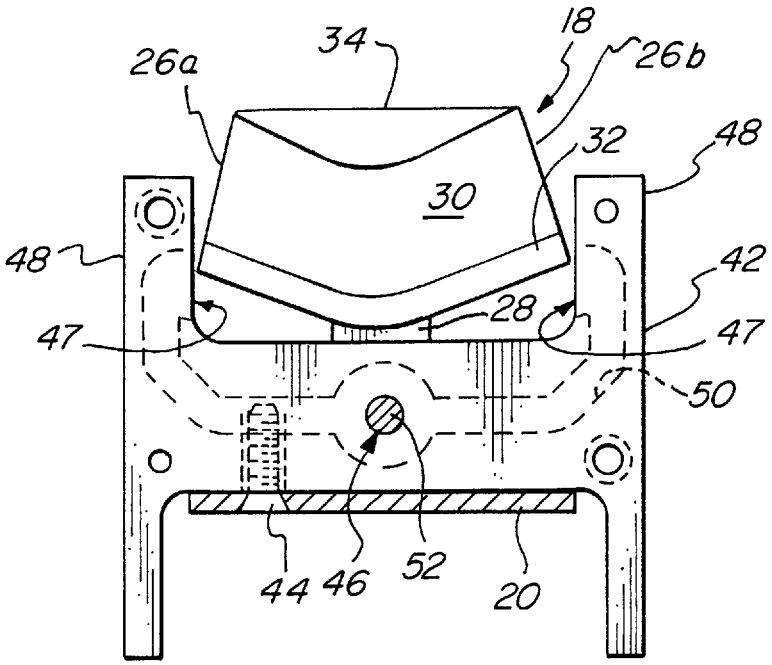
FIG. 4 is a cross-sectional view of an initiation member for firing a linear charge of explosive material in the device of Figure 1A.

One aspect of the present invention relates to an improved method for firing a linear charge of explosive material by conveying a firing signal substantially simultaneously to both sides of the linear charge. This is accomplished in the present invention through the use of an initiation manifold 42. As shown in FIG. 4, initiation manifold 42 is secured to band 20 by a mounting screw 44. Initiation manifold 42 has a central aperture 46 for receiving an initiation line such as a length of detonating cord. Initiation manifold 42 includes straddle arms 48 that engage the sides, i.e., the axial surfaces, of subassembly 18. Initiation manifold 42 comprises an internal conduit 50 which branches from a point of close proximity to aperture 46 into straddle arms 48 to at least two initiation ports 47. Straddle arms 48 are dimensioned and configured so that initiation ports 47 are juxtaposed with the sides of the linear charge. Conduit 50 contains a charge of explosive material so that the detonation of detonating cord 52 is transmitted through conduit 50 substantially simultaneously to the sides 26*a*, 26*b* of the linear explosive charge. The aperture and initiation port need not be open to expose the explosive material in the conduit; they may be covered with membranes to protect the explosive material provided the membranes permit the transfer of an explosive initiation signal therethrough.

Using manifold 42 to initiate the linear charge simultaneously at both sides yields shock waves in the charge that reinforce each other at the longitudinal centerline of the charge, enhancing the cutting performance of the charge. The reinforcement occurs most strongly at points along the linear charge where the lateral points of initiation are most directly opposite from each other; the reinforcement effect diminishes as the distance from the lateral initiation points increases. To maintain the improved performance of the reinforced shock waves, a plurality of initiation manifolds 42 may be dispersed along the length of explosive sub-assembly 18, interspersed between spacers 28. Ends of detonating cord 52 can be connected to each of the various initiation manifolds 42 and their other ends can be joined so that a single initiation device can be used to fire the detonating cords which then simultaneously convey the detonation signal to various points along the initiating sub-assembly 18 by means of the initiation manifolds 42. Using a plurality of manifolds to improve the cutting performance of the linear charge of explosive material avoids the need to imbed in the linear charge a series of non-explosive "delay" elements that split a longitudinally progressing shock wave front into laterally-originating wave fronts as taught in European Pat. Application 043 215.

Figure 5:
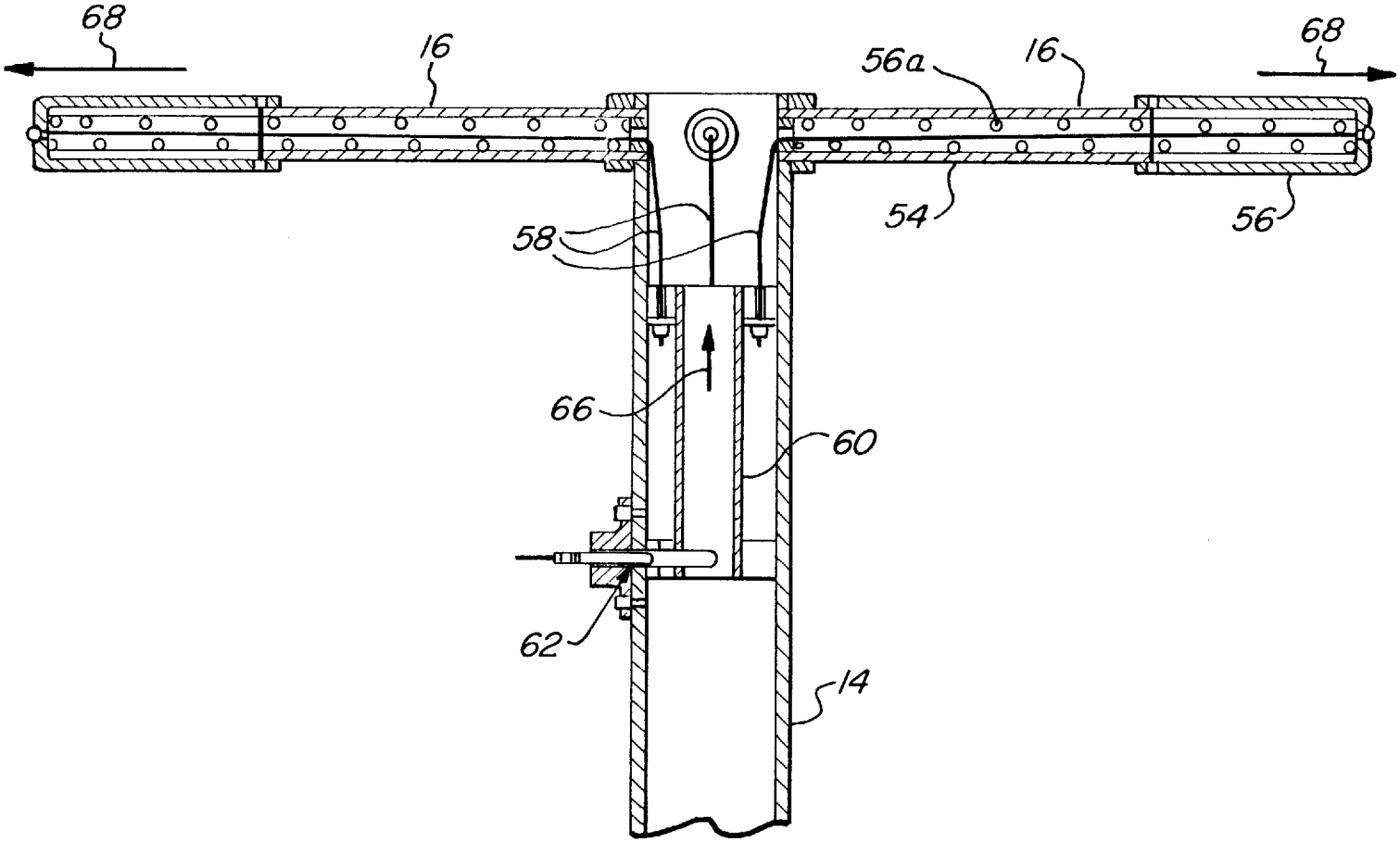
FIG. 5 is a cross-sectional view, on an enlarged scale, of one end of the pipe-cutting device of FIG. 1A, showing details of the centering arms.

Device 10 comprises extensible centering arms 16 at each end of mandrel 14, one end of which is shown in detail in FIG. 5. The following description of the operation of centering arms 16 applies equally to the arms 16 at both ends of mandrel 14. Each arm 16 comprises a hollow boom portion 54 which is fixedly secured to the end of mandrel 14. Each boom portion 54 carries an extensible dasher 56 which is slidably mounted on boom portion 54. As shown in FIG. 5, dasher 56 is disposed in a retracted position, but is biased, by means such as a spring 56*a* or the like, towards an extended position in which the length of each arm 16 is at least about the same as, or preferably exceeds, radius R (FIG. 1B) of pipe 40. However, each dasher 56 is held in the retracted position by a retaining line 58. Retaining line 58 is secured at one end to dasher 56 and passes through boom portions 54 to be secured at the other end to an anchor member 60. The bias in dashers 56 causes tension in retaining lines 58 which is borne by anchor member 60 as a force in the direction of arrow 66. Anchor member 60 is movable within mandrel 14, but is initially fixed in position by an explosive bolt 62 which is generally dimensioned and configured like explosive bolt 24 and which, like explosive bolt 24, has a hollow portion that is adapted to receive a detonator cap. An initiation signal line or fuse line extends from each bolt 62 to a distal location for use by the operator. Preferably, the signal transmission lines or fuse lines that extend from the detonator caps in bolts 62 stem from a common line so that they can be fired together using a single initiation device. When the detonator cap in explosive bolt 62 is fired, the bolt is severed at a shear groove (not shown), releasing anchor member 60 within mandrel 14. The anchor member 60 then moves towards the end of mandrel 14 in response to the tension in retaining lines 58, e.g., in the direction of arrow 66. As anchor member 60 moves towards the end of mandrel 14, dashers 56 move in the direction of arrows 68 towards the inner surface of the pipe within which the device is disposed. When dashers 56 attain their extended positions, they engage the inner surface of the pipe, thus centering the device on the pipe.

Fuse lines (not shown) extend from explosive bolts 62, explosive bolts 24 and from the manifolds on explosive sub-assembly 18 to a distal location for firing by the operator. Preferably, the fuse line that extends from sub-assembly 18 is distinguishable from those which extend from explosive bolts 62 and 24, e.g., the fuse lines extending from explosive bolts 62 and 24 may comprise signal transmission tubes, e.g., shock tube or low velocity signal tubes, while the fuse line extending from explosive sub-assembly 18 may comprise detonating cord. Differentiating the fuse lines in this way helps the operator to assure that explosive sub-assembly 18 is not fired before the device is properly centered in the pipe and the subassembly is released from carrier member 12.

Figure 6:
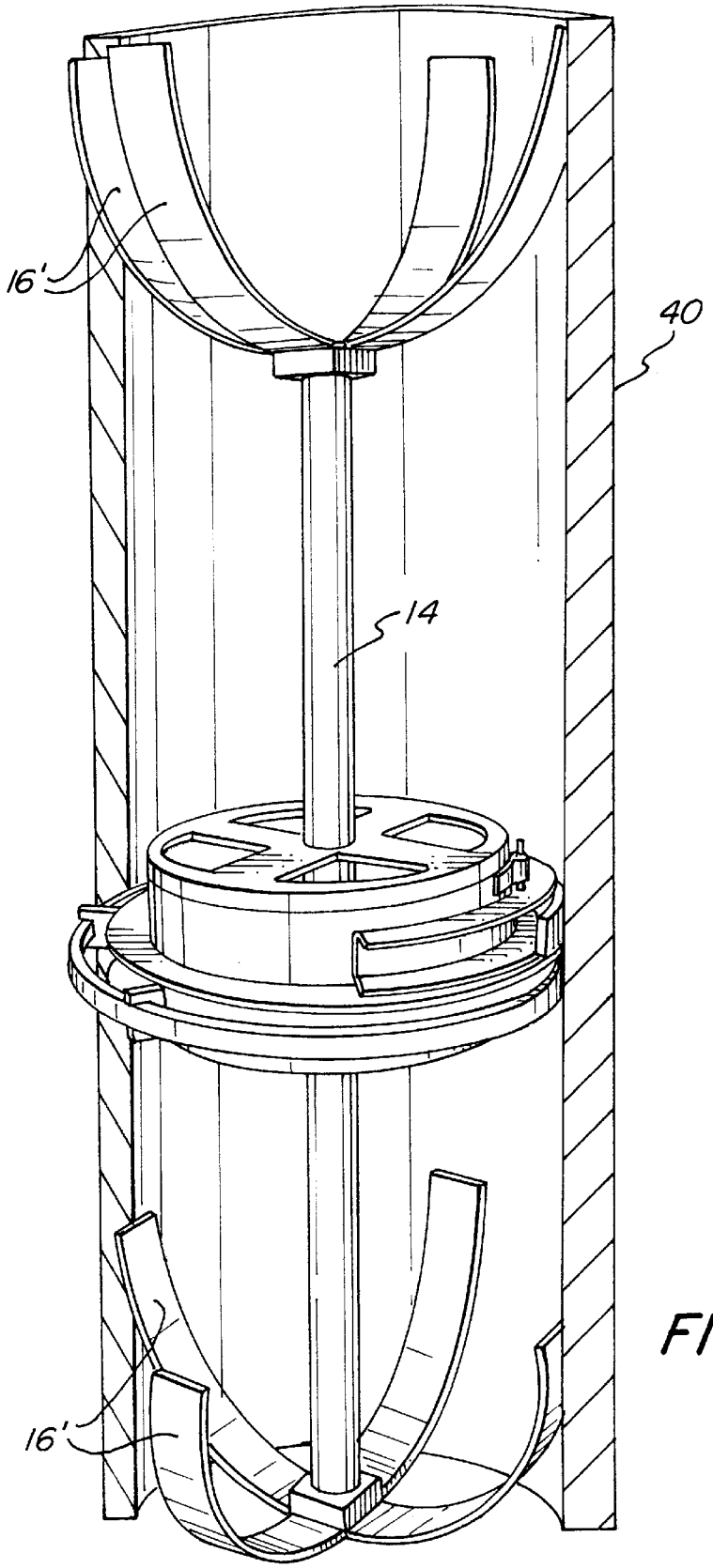
FIG. 6 is a perspective view of a pipe-cutting device in accordance with a second embodiment of the present invention, showing a pipe with part of the pipe cut away.

In an alternative embodiment of the invention shown in FIG. 6, the centering arms 16' comprise resilient members extending radially from the ends of mandrel 14. The members may comprise, e.g., bands of spring steel, which in their unflexed, extended configuration extend from mandrel 14 for a distance that exceeds the internal radius R (FIG. 1B) of pipe 40. When the device 10' is inserted into pipe 40, arms 16' flex to a contracted configuration and bear against the interior surface of the pipe at points evenly distributed about the internal circumference of the pipe, with a bias towards their unflexed configuration, thus centering device 10' within pipe 40. In this configuration, there is no need for an explosive bolt for the centering arms, i.e., bolts 62 are eliminated, so the firing sequence for using the device (described below) is simplified.

In use, device 10 is lowered to the desired position within the pipe by a cable (not shown) secured to mandrel 14 with legs 16 and sub-assembly 18 in their respective contracted configurations. Fuses for bolts 24, bolts 62 and for manifolds 42 at sub-assembly 18 extend from those devices to an initiation apparatus controlled by the operator. The operator then fires explosive bolts 62, causing dashers 56 to extend outwardly on boom portions 54 to engage the inner surface of the pipe and thus center device 10 within the pipe. The operator then fires explosive bolts 24, releasing explosive sub-assembly 18 from carrier member 12, allowing the sub-assembly to move to its expanded configuration and engage the interior surface of the pipe under the bias of the support structure, as shown in FIG. 3. At that point, the linear charge of explosive material in explosive sub-assembly 18 may be initiated via manifolds 42 to cut the pipe.

Figure 7:
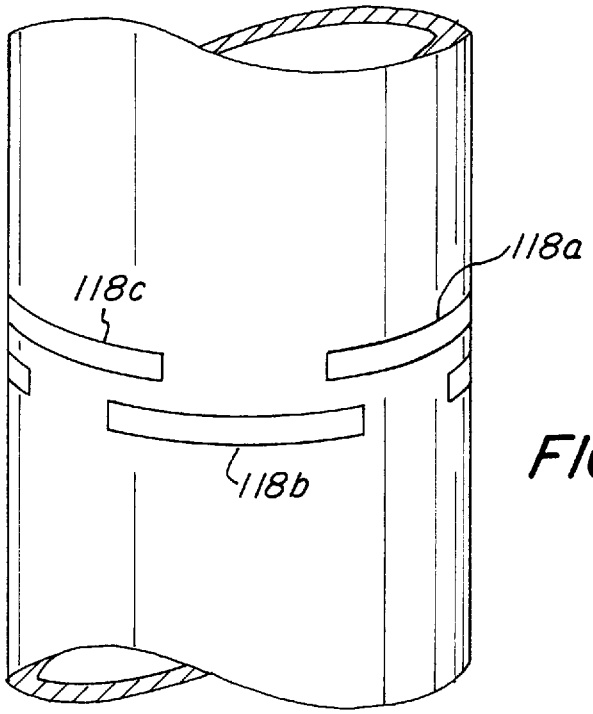
FIG. 7 is a schematic perspective view of a plurality of staggered sub-assemblies in a pipe, each sub-assembly comprising a segment of a linear explosive charge, in accordance with an alternative embodiment of a pipe-cutting device of the present invention.

As indicated above, in the embodiment of FIG. 1A etc., the circumferential explosive charge on the sub-assembly comprised a continuous length of shock wave refractive tape that extended about the entire inner circumference of the pipe being cut with one end of the charge axially overlapping the other. In an alternative embodiment suggested in FIG. 7, the pipe-cutting device may comprise a plurality of sub-assemblies 118*a*, 118*b*, etc., each of which comprises a flexible segment of linear explosive charge such as shock wave refractive tape that extends from one end of the sub-assembly to the other. As shown in FIG. 7, sub-assemblies 118*a*, 118*b*, etc., are disposed in a staggered pattern in which they engage the inner surface of the pipe. While each segment of linear explosive material is shorter than the internal circumference of the pipe, the total length of all the segments in the device exceeds the interior circumference of the pipe. The ends of the linear explosive charges therein can therefore overlap one another on the pipe surface as sensed in the direction of the pipe's central longitudinal axis. Together, the segments of linear explosive material comprise the circumferential explosive charge of the device. The mid-portions of the linear charges need not overlap other charges. Preferably, the axial offset between the ends of consecutively staggered sub-assemblies is equal to not more than about the width of the linear explosive charge therein.

Figure 8:
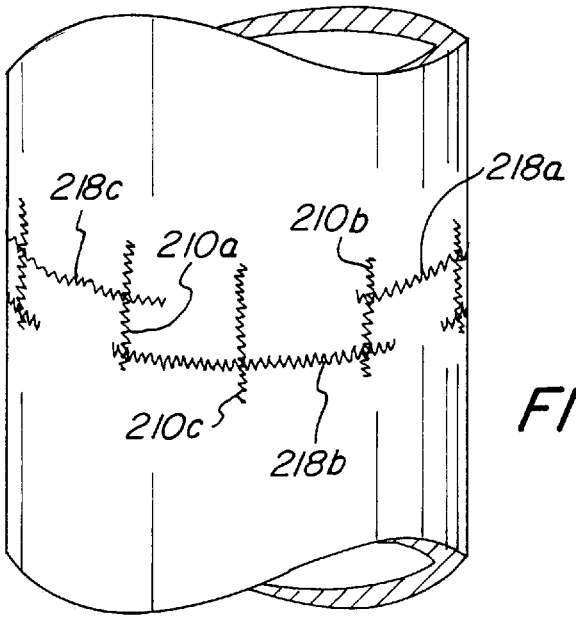
FIG. 8 is a schematic perspective view of the pipe of FIG. 7 immediately after the charges of the device therein are detonated, showing a pattern of fractures in the pipe wall.

When the sub-assemblies arranged as shown in FIG. 7 detonate, each creates a circumferential primary fracture in the pipe wall along that portion of the pipe's inner surface engaged by the linear explosive charge of the subassembly. Thus, sub-assembly 118*b* causes a partially circumferential primary fracture 218*b* (FIG. 8). When staggered, overlapping linear charges are initiated simultaneously, the resulting shock waves produced in the pipe reinforce each other in the overlap region, producing axial overlap fractures in the pipe that extend between the primary fractures. Thus, in the region where the ends of sub-assemblies 118*b* and 118*c* overlap, an axial overlap fracture 210*a* will be created when the two linear explosive charges therein detonate simultaneously. Overlap fractures serve to connect the primary fractures 218*a*, 218*b*, etc., and thus assure that the pipe wall sustains uninterrupted fracture damage about its inner circumference. (The overlapping ends of the device of FIG. 3 likewise produce an axial overlap fracture between them.) In addition to primary and overlap fractures, axial midsegment fractures such as fracture 210*c* can also be produced by initiating the linear charges of explosive material in the sub-assemblies at more than one point along their lengths, as will be discussed further below.

Each sub-assembly is mounted to the carrier member by deployment means. In the embodiment shown schematically in FIG. 9, the deployment means is mounted on a carrier plate 112 and comprises a piston 124*a* slidably disposed within a pneumatic cylinder 125. A spring 124*b* within the cylinder biases the piston 124*a* outward. When activated by the user, the deployment means moves the sub-assembly from a retracted configuration (indicated in dotted outline) to the illustrated extended configuration in which the sub-assembly 118*a* engages the inner wall of the pipe 40 to be cut.

Figure 9:
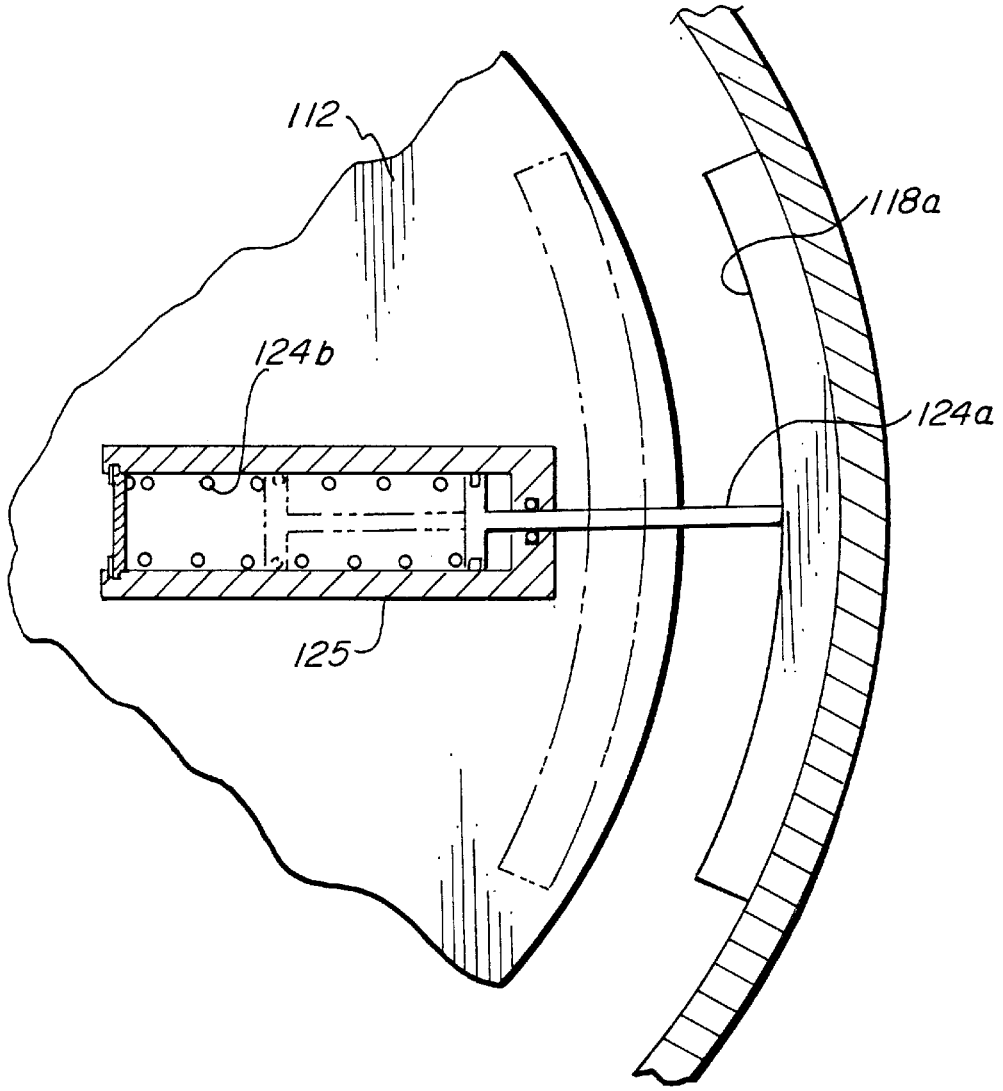
FIG. 9 is a schematic plan view of a sub-assembly and deployment means of a pipe-cutting device of the type suggested by FIG. 7.
Figure 10:
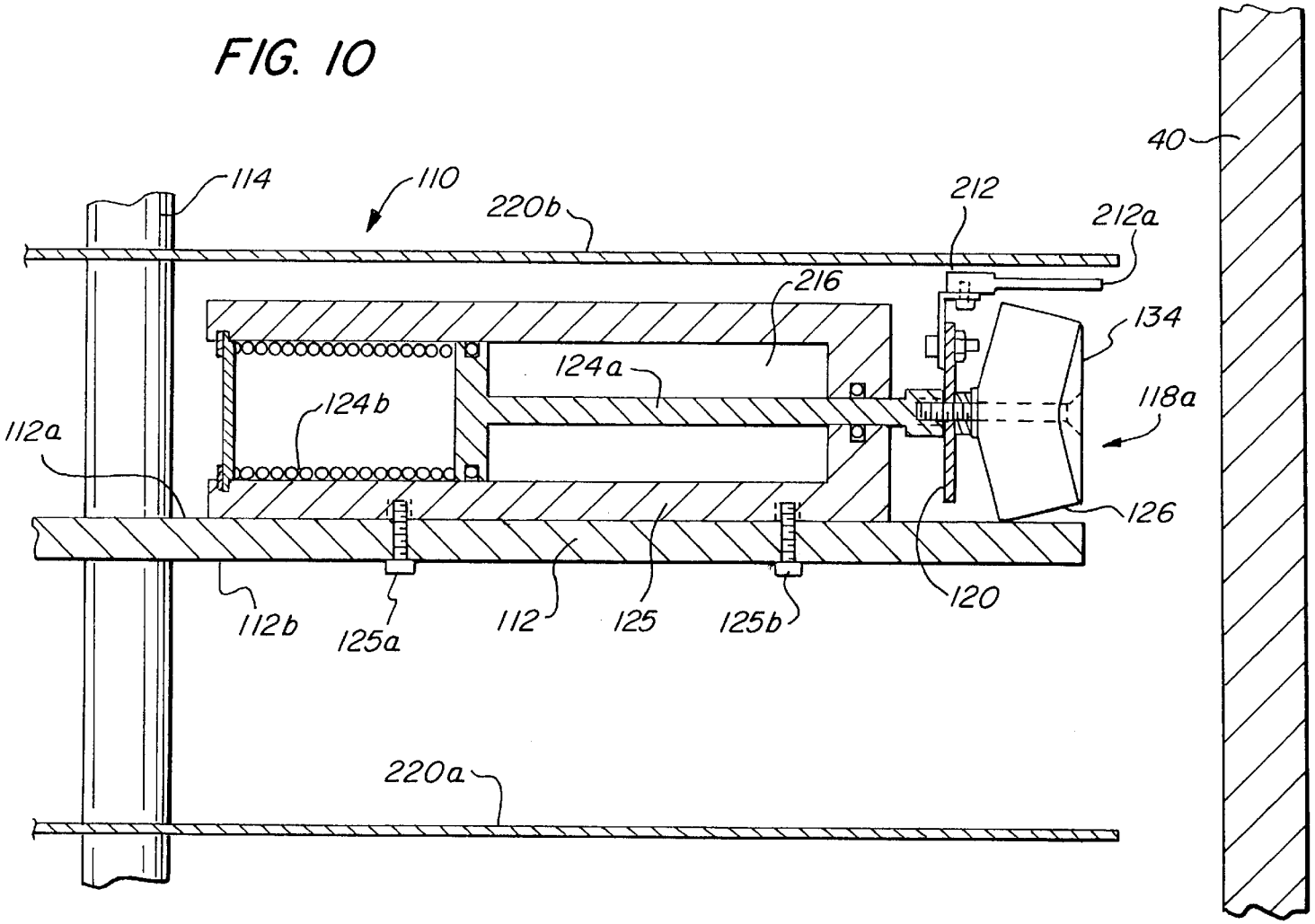
FIG. 10 is a schematic cross-sectional view of the sub-assembly and deployment means of FIG. 9.

FIG. 10 shows part of a device 110 in accordance with the alternative embodiment of FIGS. 8 and 9. Device 110 comprises a carrier plate 112 that is mounted on a mandrel 114. Carrier plate 112 has two sides, 112*a* and 112*b*, is disk-shaped and is carried on mandrel 114 in perpendicular relation to the longitudinal axis of mandrel 114. FIG. 10 shows the sub-assembly and some detail of the deployment means of FIG. 9 as it would appear in the retracted configuration. Sub-assembly 118*a* comprises a refractive tape segment 126 and a charge-shaping element 134 mounted on spring band segment 120 in the same manner that shock wave refractive tape 26 is attached to band 20, as described with reference to FIG. 2. Sub-assembly 118*a* also comprises a conventional sensing mechanism 212 having a sensing arm 212*a* and extends beyond sub-assembly 118*a* towards the wall of pipe 40. A deployment means provided by pneumatic cylinder 125 is mounted on side 112*a* of carrier plate 112 by securing screws 125*a*, 125*b*. Cylinder 125 is divided by piston 124*a* into two portions; one portion that contains a spring 124*b* and another portion 216 that contains compressed air. The pressure of the compressed air in portion 216 is sufficient to force piston 124*a* to compress spring 124*b* so that its coils bear upon each other as shown. The compressed air can later be released by a remotely operable release valve to allow the spring to push the piston outward. Thus, the compressed air serves as a releasable restraining means to releasably hold the pneumatic deployment means in the retracted configuration.

Device 110 comprises shielding plates 220*a*, 220*b* which are mounted on mandrel 114 in parallel relation to carrier plate 112. Shielding plates 120*a* and 120*b* are disk-shaped and preferably have a diameter about 4 inches shorter than the internal diameter of the pipe to be cut by the device. Preferably, carrier plate 112, the deployment means and the sub-assembly 118*a* are dimensioned and configured so that when sub-assembly 118*a* is in the retracted configuration it is disposed entirely within the circumference of shielding plates 220*a* and 220*b*. Thus, when sub-assembly 118*a* is in the retracted configuration and the device is being inserted into a pipe, shielding plates 220*a* and 220*b* can serve to protect sub-assemblies 118*a*, 118*b*, etc., from damage due to obstructions that protrude into the interior of the pipe. The deployment means is further dimensioned and configured so that it moves sub-assembly 118*a* radially away from mandrel 114 to beyond the circumference of shielding plates 220*a* and 220*b* and into an extended configuration in which it engages, i.e., makes contact with, pipe 40. Generally, the deployment means should provide radial travel of about 3 inches to allow sub-assembly 118*a* to pass the circumference of shielding plates 220*a*, 220*b* and to come into contact with pipe 40. When such contact is made, sensing arm 212*a* comes into contact with pipe 40, causing sensing mechanism 212 to send a signal to the user to confirm that the explosive charge of sub-assembly 118*a* has made proper contact with pipe 40. The signal may be conveyed electrically, via a wire that is among the lines that extend from the device in the pipe to the user.

Figure 11:
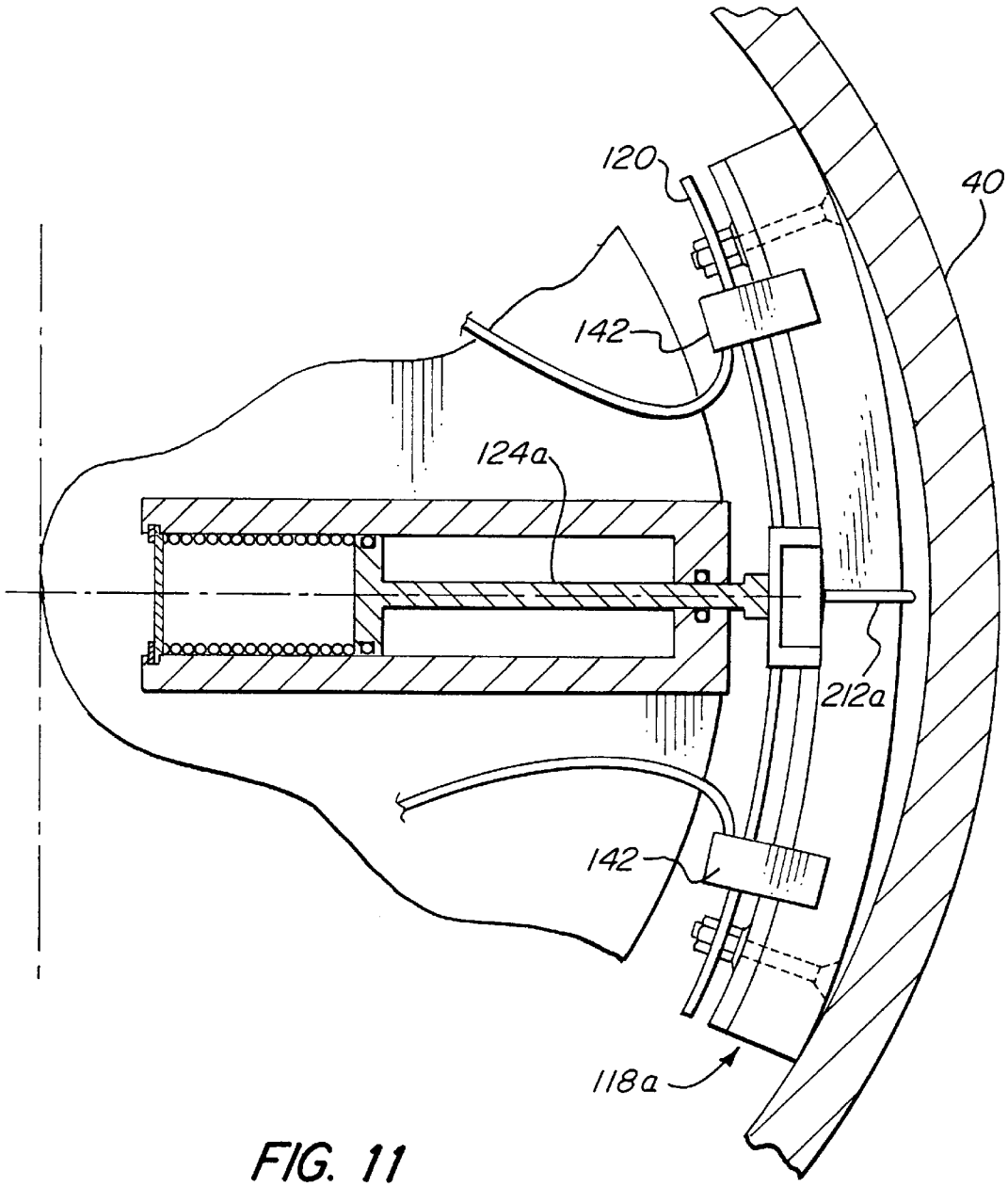
FIG. 11 is a schematic plan view showing the sub-assembly of FIG. 9 in position prior to full deployment, to illustrate the difference in curvature between the sub-assembly and the pipe wall.

Preferably, each sub-assembly 118*a*, 118*b*, etc., has, in the retracted configuration, a radius of curvature slightly larger than that of the interior of pipe 40. Accordingly, as the sub-assembly 118*a*, 118*b*, etc., moves from the retracted configuration towards the extended configuration, the first points of contact between the subassembly and the pipe are at the ends of the sub-assembly, as indicated in FIG. 11. In this situation, the midportion of the explosive charge of the sub-assembly and, preferably, sensing arm 212*a*, are not yet in contact with pipe 40. Since the sub-assembly is flexible, piston 124*a* can extend even further so that sensing arm 212*a* and the middle portion of sub-assembly 118*a* come into contact with pipe 40. Thus, the generation of a signal from sensing mechanism 212 generally indicates full contact between the explosive material in sub-assembly 118*a* and the pipe.

Preferably, device 110 comprises a first plurality of sub-assemblies mounted on one side of carrier plate 112 and a second plurality of sub-assemblies mounted on the other side. In a particular embodiment, the first plurality comprises four sub-assemblies mounted on one side of the carrier plate at ninety-degree intervals about the plate's circumference. The second plurality also comprises four sub-assemblies mounted on the other side of the carrier plate at ninety-degree intervals about the plate's circumference, and the sub-assemblies of the second plurality may be positioned at circumferential locations between those of the first plurality to achieve a staggered configuration as suggested in FIG. 6. Preferably, the springs of the pneumatic cylinders for the subassemblies are not fully relaxed even when the sub-assemblies engage the inner surface of the pipe, and can therefore be said to bias the explosive charges into a configuration having a radius that exceeds the internal radius of the pipe.

Preferably, device 110 comprises centering arms (not shown) like arms 16 (FIG. 1A) or arms 16' (FIG. 6) to properly center the device within the pipe.

Each sub-assembly 118*a*, 118*b*, etc., comprises at least one, but preferably two, initiation manifolds 142 (FIG. 11) by which the shock wave refractive tape can be initiated. Optionally, the initiation manifold may be of the type shown in FIG. 4. By using two initiation manifolds to initiate the explosive charge simultaneously at two points along its length, two shock waves will be created within the explosive charge and within the pipe wall, each emanating from the location of an initiation manifold on the sub-assembly. Preferably, the initiation points are equidistant from the middle of the linear explosive charge. At the point where the two shock waves reinforce each other (about mid-way between the initiation points), the coincidence of the detonation waves will produce an axially-oriented mid-segment fracture 210*c* (FIG. 8) in the pipe that runs generally perpendicular to the principal fracture produced by the explosive charge. These midsegment fractures cooperate with the overlap fractures 210*a*, 210*b* to reduce the hoop strength integrity of the pipe wall about the circumferential fracture region. As a result, the pipe wall is more easily breached by the pressure pulse produced by the detonation of the explosive material in the sub-assemblies.

The use of device 110 is similar to that of device 10 in that device 110 is lowered to the desired position in the pipe by a cable with the sub-assemblies in the retracted positions. Fuses for manifolds 142 (and, if appropriate, for exploding bolts that release spring-loaded centering arms) and signal wires for the air release valves (not shown) and for the sensing mechanisms 212 extend from the device to a control unit held by the operator. When the device is centered in the pipe at the desired cutting location, the operator electrically signals the release valves to release the compressed air in the pneumatic cylinders, thus allowing springs 124*b* to move sub-assemblies 118*a*, 118*b*, etc., into their extended positions. When the user receives confirmation from the sensing mechanisms 212 that the sub-assemblies are properly engaging the inner wall of the pipe, the user can then initiate the sub-assemblies to sever the pipe.

While the invention has been described in detail with reference to particular embodiments thereof, it will be apparent that upon a reading and understanding of the foregoing, numerous variations to the described embodiment will occur to those skilled in the art and it is intended to include such variations within the scope of the appended claims.

What is claimed is:

1. A device for explosively cutting a pipe having a longitudinal axis, an inner wall and an internal circumference, the device comprising:

a carrier member having a periphery;

circumferential explosive means having at least one midportion and at least two ends, for providing an explosive force about the interior circumference of the pipe to cut the pipe;

deployment means carried on the carrier member for holding the explosive means in a retracted configuration and for moving the explosive means from the retracted configuration to a circumferential extended configuration that exceeds the periphery of the carrier member to permit the explosive means to engage the inner wall of a pipe to be cut, and in which at least one end of the explosive means is disposed in an axially overlapping configuration with respect to another end; and initiation means for initiating each explosive means when it is in the extended configuration.

2. The device of claim 1 comprising at least one sensor to signal when the explosive charge engages the interior wall of the pipe to be cut.

3. The device of claim 1 wherein the explosive means comprises a plurality of explosive charge segments.

4. The device of claim 3 wherein the extended configuration of the explosive charge segments comprises a staggered arrangement about the periphery of the carrier member.

5. The device of any one of claim 1, claim 2, claim 3 or claim 4 wherein the deployment means biases the circumferential explosive means towards a configuration that defines a radius larger than the radius of the interior circumference of the pipe to be cut.

6. The device of claim 1 or claim 2 wherein the circumferential explosive means comprises a pair of generally parallel sides and wherein the initiation means comprises at least one initiation manifold, the manifold being dimensioned and configured to receive an initiation signal and to detonate the circumferential explosive means at both sides thereof in response to the initiation signal.

7. The device of claim 1, claim 2, claim 3 or claim 4 comprising releasable restraining means for releasably holding the deployment means in the retracted configuration.

8. The device of claim 7 wherein the deployment means comprises a movable elongate support structure and wherein the retracted configuration and the circumferential extended configuration are helical configurations.

9. The device of claim 8 wherein the elongate support structure has a length that exceeds the circumference of the carrier member.

10. The device of claim 8 wherein the support structure comprises a spring band.

11. The device of claim 9 wherein the circumferential explosive means comprises a single linear charge of explosive material having a length that exceeds the inner circumference of the pipe.

12. The device of claim 1 further comprising a plurality of centering arms mounted to the carrier member.

13. The device of claim 12 wherein the centering arms are movable between a retracted configuration for facilitating insertion of the device into the pipe and an extended configuration engaging the pipe wall to center the device within the pipe, the arms being biased towards the extended configuration, the device further comprising a release mechanism for releasably holding the arms in the retracted configuration.

14. The device of claim 12 wherein the centering arms comprise a plurality of resilient members that extend radially from the carrier member and that are dimensioned and configured to extend from the carrier member for a distance that exceeds the internal radius of the pipe to be cut, whereby when the device is inserted into the pipe the resilient members bear against the interior surface of the pipe to center the device therein.

15. A device for explosively cutting a pipe having a longitudinal axis, an inner wall and an internal circumference by disposing and initiating the device therein, the device comprising:

a carrier member having a periphery;

at least one movable explosive charge carried on the carrier member by deployment means for holding the at least one explosive charge in a retracted configuration and for moving the charge from the retracted configuration to an extended configuration in which the at least one explosive charge is disposed in a circumferential extended configuration to engage the inner wall of a pipe to be cut; and sensor means for signaling to the user when the at least one explosive charge has engaged said inner wall.

* * * * *

UNITED STATES PATENT AND TRADEMARK OFFICE

CERTIFICATE OF CORRECTION

PATENT NO. : 5,816,747
DATED : October 6, 1998
INVENTOR(S) : Brendan M. Welch et al It is certified that error appears in the above-identified patent and that said Letters Patent is hereby corrected as shown below:

In column 5, line 23, after "fuse" delete "35";

line 45, replace "subassembly" with --sub-assembly--.

In column 6, line 66, replace "subassembly" with --sub-assembly--.

In column 7, line 62, replace "subassembly" with --sub-assembly--.

In column 8, line 10, replace "midsegment" with --mid-segment--.

Signed and Sealed this

Fourth Day of May, 1999

*Attest:*

Q. TODD DICKINSON

*Attesting Officer*

*Acting Commissioner of Patents and Trademarks*